US011603292B2

(12) United States Patent
Kim et al.

(10) Patent No.: US 11,603,292 B2
(45) Date of Patent: Mar. 14, 2023

(54) ELEVATOR CORE STRUCTURE THAT CAN BE PRE-CONSTRUCTED AND METHOD FOR PRECONSTRUCTING ELEVATOR CORE USING SAME

(71) Applicant: SAMSUNG C&T CORPORATION, Seoul (KR)

(72) Inventors: Dae Joong Kim, Seoul (KR); Wha Sung Kim, Seongnam-si (KR); Yong Ku Kim, Seoul (KR); Jae Eun Jung, Seongnam-si Gyeonggi-do (KR); Yeon Kyu Park, Seongnam-si (KR); Sang Hee Lee, Anyang-si (KR); Nan Hee Lee, Anyang-si (KR)

(73) Assignee: SAMSUNG C&T CORPORATION, Seoul (KR)

( * ) Notice: Subject to any disclaimer, the term of this patent is extended or adjusted under 35 U.S.C. 154(b) by 353 days.

(21) Appl. No.: 16/759,228

(22) PCT Filed: Oct. 17, 2018

(86) PCT No.: PCT/KR2018/012254
§ 371 (c)(1),
(2) Date: Apr. 24, 2020

(87) PCT Pub. No.: WO2019/083218
PCT Pub. Date: May 2, 2019

(65) Prior Publication Data

US 2020/0331728 A1 Oct. 22, 2020

(30) Foreign Application Priority Data

Oct. 27, 2017 (KR) ..... 10-2017-0141297

(51) Int. Cl.
*B66B 11/00* (2006.01)
*E04G 13/00* (2006.01)
(Continued)

(52) U.S. Cl.
CPC ..... *B66B 19/00* (2013.01); *B66B 11/0005* (2013.01); *B66B 13/301* (2013.01);
(Continued)

(58) Field of Classification Search
CPC ..... E04F 17/005; E04G 13/00; E04G 13/301; B66B 11/0005; B66B 13/306
See application file for complete search history.

(56) References Cited

U.S. PATENT DOCUMENTS 3,948,358 A * 4/1976 Atkey ..... B66B 7/02 187/408
4,231,148 A * 11/1980 Harding ..... E04F 17/005 29/469
(Continued)

FOREIGN PATENT DOCUMENTS

DE 1784745 A1 * 8/1971
EP 1101882 A1 * 5/2001 ..... B66B 7/02
(Continued)

OTHER PUBLICATIONS

International Search report, with English translation, corresponding to International Application No. PCT/KR2018/012254, dated Feb. 22, 2019.

*Primary Examiner* — Christine T Cajilig
(74) *Attorney, Agent, or Firm* — Kile Park Reed & Houtteman PLLC

(57) ABSTRACT

In accordance with the present invention, an elevator core structure includes an elevator frame (120) separated from a main frame (110) and extending in a longitudinal direction of the main frame (110), and a guide frame (130) formed on an inner surface of the elevator frame (120). Here, the elevator frame (120) may be formed by stacking a plurality of frame segments (121), and a guide frame unit (131) forming the guide frame (130) may be mounted to one surface of each of the frame segments (121). The present
(Continued)

invention exhibits an effect of early-constructing the elevator frame regardless of a construction schedule of a main frame of a building.

8 Claims, 23 Drawing Sheets

(51) Int. Cl.

| | |
|---|---|
| ***E04B 1/34*** | (2006.01) |
| ***E04F 17/00*** | (2006.01) |
| ***B66B 19/00*** | (2006.01) |
| ***B66B 13/30*** | (2006.01) |
| ***E04B 1/35*** | (2006.01) |
| ***E04B 1/19*** | (2006.01) |

(52) U.S. Cl.
CPC ..... *B66B 13/306* (2013.01); *E04B 1/19* (2013.01); *E04B 1/34* (2013.01); *E04B 1/35* (2013.01); *E04F 17/005* (2013.01); *E04G 13/00* (2013.01)

(56) References Cited

U.S. PATENT DOCUMENTS

| | | | | |
|---|---|---|---|---|
| 8,800,724 | B1 * | 8/2014 | Foster | B66B 19/00 187/414 |
| 9,850,653 | B1 * | 12/2017 | Gerard | E04F 17/005 |
| 2012/0073214 | A1 * | 3/2012 | Sie | E04F 17/005 52/274 |

FOREIGN PATENT DOCUMENTS

| | | | |
|---|---|---|---|
| JP | 2771338 | | 7/1998 |
| JP | 11-335023 | | 12/1999 |
| JP | 2011-051741 | | 3/2011 |
| JP | 2011051741 | A * | 3/2011 |
| KR | 20-0169528 | | 2/2000 |
| KR | 10-0996117 | | 11/2010 |
| KR | 100996117 | B1 * | 11/2010 |

* cited by examiner

Prior Art

Prior Art

Prior Art

Prior Art

Prior Art

Prior Art

Prior Art

Prior Art

Prior Art

Prior Art

ELEVATOR CORE STRUCTURE THAT CAN BE PRE-CONSTRUCTED AND METHOD FOR PRECONSTRUCTING ELEVATOR CORE USING SAME

CROSS-REFERENCE TO RELATED APPLICATIONS

This application is a national entry of International Application No. PCT/KR2018/012254, filed on Oct. 17, 2018, which claims priority to Korean Patent Application No. 10-2017-0141297 under 35 U.S.C. § 119, filed on Oct. 27, 2017, the entire contents of which are hereby incorporated by reference.

TECHNICAL FIELD

The present invention relates to an architecture or civil engineering field, and more particularly, to an early construction elevator core structure allowing an elevator core to be early-constructed regardless of whether construction of a main frame of a building including a large manufacturing facility for a semiconductor or a display is completed, and an early construction method of the elevator core by using the same.

BACKGROUND ART

In general, when a building including an elevator is constructed, a frame of the elevator and a main frame of the building are constructed based on the same schedule.

Thus, the elevator may not be driven until the building is completely constructed.

However, in case of a building including a manufacturing facility such as a clean room, large equipment may be necessarily carried inside the building before construction of the building is completed for the purpose of reducing a mass production time to secure business competitiveness. In this case, when a large elevator is able to early-operate, a schedule for completing the construction of the building may be reduced.

However, since the frame for forming an elevator core is integrated with the main frame of the building as described above, the elevator core may not be early-constructed before the building frame is completely constructed.

Thus, a total construction process of the building including a manufacturing facility for a semiconductor and a display such as a clean room requires a long construction time.

DISCLOSURE OF THE INVENTION

Technical Problem

The present invention provides an early construction elevator core structure allowing an early installation and operation of an elevator by early-constructing an elevator frame regardless of a construction schedule of a main frame of a building, and an early construction method of the elevator core by using the same.

The present invention also provides an early construction elevator core structure that is constructed such that an elevator frame of an elevator core is constructed separately from a main frame of a building to flexibly adjust a total construction schedule of the building, and an exterior construction of an elevator front room is performed separately for each of an elevator portion and a front room portion, so that construction of the elevator core and main construction are completely separated, and an early construction method of the elevator core by using the same.

The present invention also provides an early construction elevator core structure allowing large equipment to be carried into a building without using separate crane equipment by driving and utilizing an elevator before construction of the building is completed, and an early construction method of the elevator core by using the same.

Technical Solution

In accordance with an embodiment of the present invention, an elevator core structure includes: an elevator frame 120 separated from a main frame 110 and extending in a longitudinal direction of the main frame 110; and a guide frame 130 formed on an inner surface of the elevator frame 120.

In an embodiment, the elevator frame 120 may be formed by stacking a plurality of frame segments 121, and a guide frame unit 131 forming the guide frame 130 may be mounted to one surface of each of the frame segments 121.

In an embodiment, the elevator core structure may further include: an elevator unit 10 inserted to the elevator frame 120; and a front room 200 formed in the main frame 110. Here, the front room 200 may include: an elevator hoistway 210 configured to connect the elevator unit 10 and the front room 200; and a jamb 220 mounted to each of both side surfaces of the elevator hoistway 210.

In an embodiment, the jamb 220 may include: a first jamb 221 mounted to the elevator frame 120; and a second jamb 222 mounted to the main frame 110.

In an embodiment, the first jamb 221 and the second jamb 222 may closely contact each other.

In an embodiment, the elevator core structure may further include a sealing part 300 disposed between the elevator hoistway 210 and the elevator unit 10. Here, the sealing part 300 may include: a horizontal beam 310 extending in a width direction a of the elevator unit 10; and a bracket 320 installed below the horizontal beam 310 and coupled to the main frame 110 to support the horizontal beam 310.

In an embodiment, the bracket 320 may include: an angle 321 coupled with the main frame 110; and a movable plate 322 disposed on the angle 321 and moving in a thickness direction b of the horizontal beam 310.

In an embodiment, the horizontal beam 310 may include: an H-beam 311 disposed on the movable plate 322; and a concrete member 312 formed by on-site pouring into a space between the H-beam 311 and the main frame 110.

In accordance with another embodiment of the present invention, an early construction method of an elevator core by using the early construction elevator core structure includes: a first process S100 of simultaneously constructing the main frame 110 and the elevator frame 120; a second process S200 of attaching a cove plate 122 to an outer surface of the elevator frame 120; and a third process S300 of inserting the elevator unit 10 to the elevator frame 120.

In an embodiment, the early construction method may further include: an early mounting process S110 of mounting the first jamb 221 after the first process S100; and an early mounting process S310 of mounting the second jamb 222 after the third process S300.

In an embodiment, the second jamb 221 may be mounted after the main frame 110 is completely constructed.

Advantageous Effects

The present invention exhibits the effect of early-constructing the elevator frame regardless of the construction schedule of the main frame of the building.

The present invention also exhibits the effect of completely separating the construction of the elevator core from the main construction such that the elevator frame of the elevator core and the main frame of the building are separately constructed to flexibly adjust the total construction schedule of the building, and the exterior construction of the elevator hoistway is early-constructed, so that the elevator and the main frame are separately constructed.

The present invention also exhibits the effect of driving and utilizing the elevator before the construction of the building is completed, so that large equipment is carried inside the building without using separate crane equipment.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

MODE FOR CARRYING OUT THE INVENTION

Figure 1:
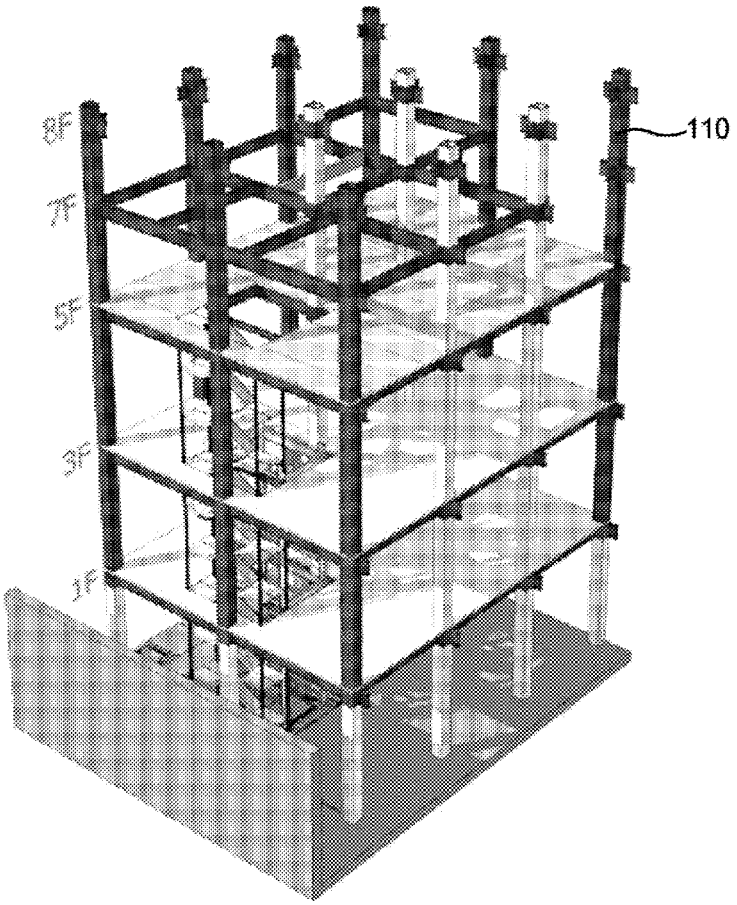
FIGS. 1 to 3 are views for explaining a building construction sequence in case of an early construction elevator core in accordance with an embodiment of the present invention.
Figure 2:
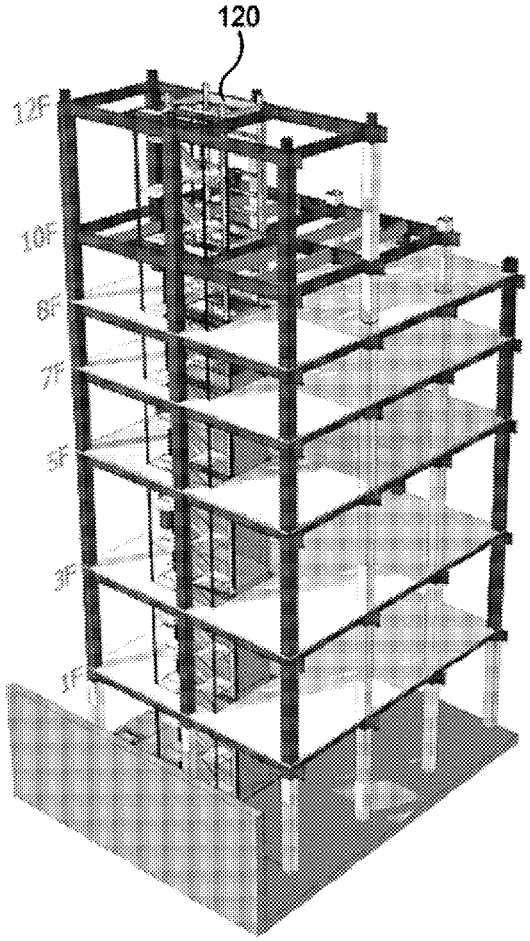
Figure 3:
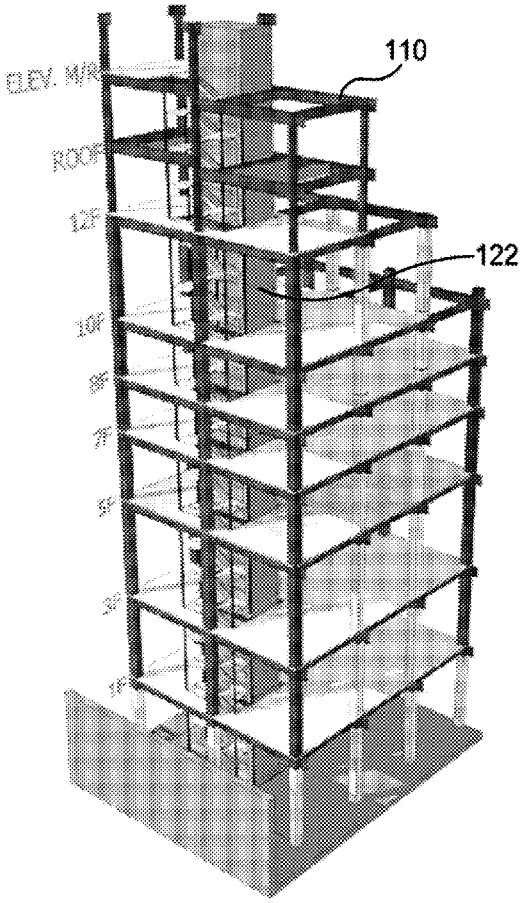

Embodiments of an early construction elevator core structure and an early construction method of an elevator core by using the same in accordance with the present invention will be described in detail with reference to the accompanying drawings. In describing with reference to the accompanying drawings, like reference numerals refer to like elements throughout, and redundant description thereof will be omitted.

Also, though terms like a first and a second are used to describe various members, components, regions, layers, and/or portions in various embodiments of the present invention, the members, components, regions, layers, and/or portions are not limited to these terms.

When it is described that an element is "coupled to", "engaged with", or "connected to" another element, it should be understood that the element may be directly coupled or connected to the other element but still another element may be "coupled to", "engaged with", or "connected to" the other element between them.

The present invention relates to an early construction elevator core structure providing convenience of utilizing an elevator during building construction requiring large equipment to carry inside a building by early-constructing an elevator core to early-drive the elevator regardless of a construction schedule of a main frame of the building, and an early construction method of an elevator core using the same.

In the present invention, the elevator core represents a space occupied by an elevator frame 120, and a front room and an elevator hoistway represent a building portion contained in a main frame 110.

Hereinafter, an embodiment of the present invention will be described with reference to the accompanying drawings.

Figure 5:
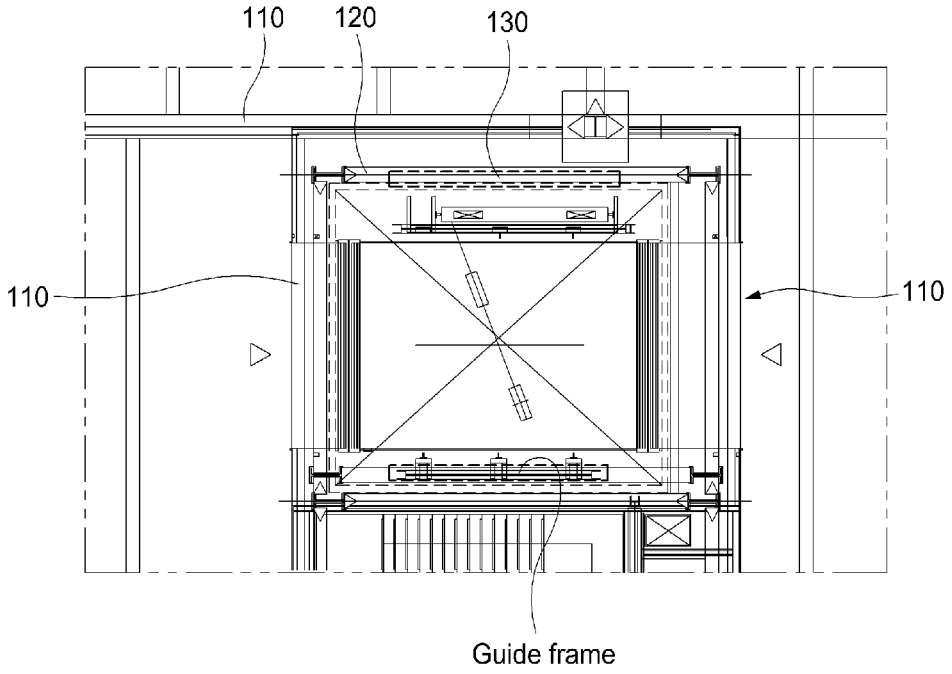
FIG. 5 is a view illustrating a structure of a guide frame integrated with an elevator frame in accordance with an embodiment of the present invention.

An early construction elevator core structure in accordance with an embodiment of the present invention basically includes an elevator frame 120 separated from a main frame 110 and extending in a longitudinal direction of the main frame 110 and a guide frame 130 formed on an inner surface of the elevator frame 120 (refer to FIG. 5).

In this case, the elevator frame 120 may be formed by stacking a plurality of frame segments 121, and a guide frame unit 131 forming the guide frame 130 may be mounted to one surface of each of the frame segments 121.

Figure 4:
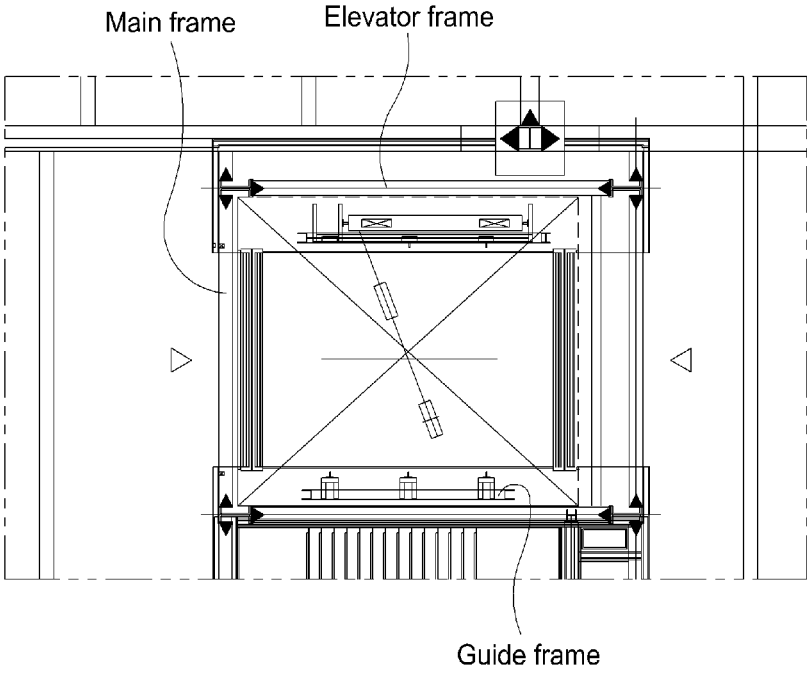
FIG. 4 is a view illustrating a typical structure of an elevator frame and a guide frame.

As illustrated in FIG. 4, a typical elevator frame is integrated with a main frame of a building.

Thus, since the elevator frame is constructed based on a construction schedule of the main frame, an elevator may not be driven until the main frame is completely constructed.

In accordance with the present invention, since the elevator frame 120 and the main frame 110 are separately constructed, the elevator frame 120 may be constructed earlier than the construction schedule of the main frame 110, and thus the elevator may be driven before the building including the main frame 110 is completely constructed.

In addition, since large equipment installed in the building or an interior member may be transferred by using the driven elevator, high cost equipment such as a crane may not be required to operate, and additionally, a total construction period may be reduced.

Figure 6:
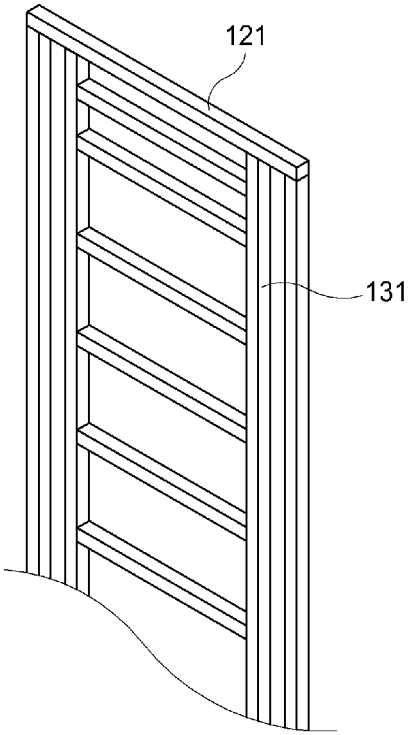
FIG. 6 is a three-dimensional perspective view illustrating a construction state of the guide frame in accordance with an embodiment of the present invention.
Figure 7:
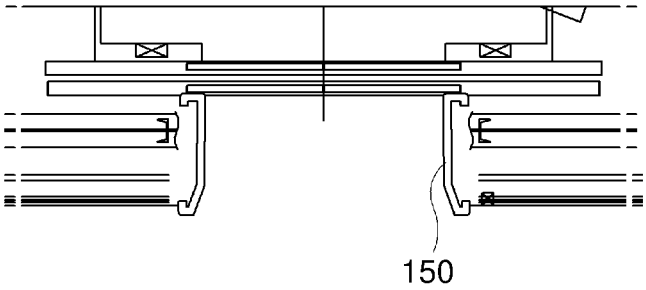
FIG. 7 is a view illustrating a structure of a jamb of a typical elevator.
Figure 8:
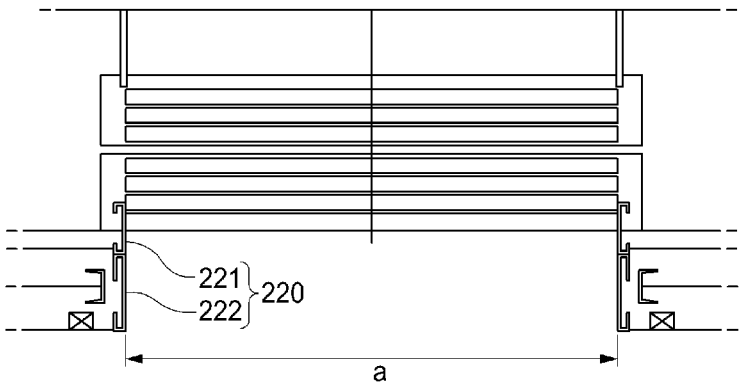
FIG. 8 is a view illustrating a structure of a jamb of an elevator in accordance with an embodiment of the present invention.
Figure 9:
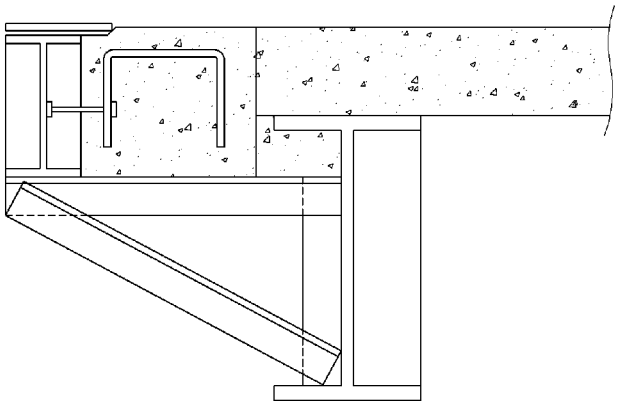
FIG. 9 is a view illustrating a structure of a sill bracket supporting a typical elevator sill.

Also, since the elevator frame 120 and the guide frame 130 are integrated with each other in accordance with the present invention, a separate process of constructing the guide frame 130 may not be required, and a margin area of a hoistway in the elevator frame 120 may be maximally secured (refer to FIGS. 5 and 6).

Also, since the guide frame unit 131 is integrated to the frame segment 121 and early-manufactured in a factory, a construction difficulty level of the elevator core may be reduced, and a construction time may be also reduced.

The early construction elevator core structure in accordance with an embodiment of the present invention may further include an elevator unit 10 inserted to the elevator frame 120 and a front room 200 formed in the main frame 110.

In this case, the front room 200 may include an elevator hoistway 210 connecting the elevator unit 10 and the front room 200 and a jamb 220 mounted to both side surfaces of the elevator hoistway 210.

Since a typical jamb 150 is a single member, the jamb 220 may be installed after a construction for finishing a wall of the front room 200 including the main frame 110 is completed.

In comparison, the jamb 220 in accordance with the present invention is characterized by separately including a first jamb 221 mounted to the elevator frame 120 and a second jamb 222 mounted to the main frame 110 so that the first jamb 221 is installed even before the main frame 110 is constructed when the elevator core is early-constructed.

In this case, the first jamb 221 and the second jamb 222 may closely contact each other.

Thus, a construction time of a building interior may be reduced, and also, a safety accident while equipment is transferred by using the elevator may be prevented.

Figure 10:
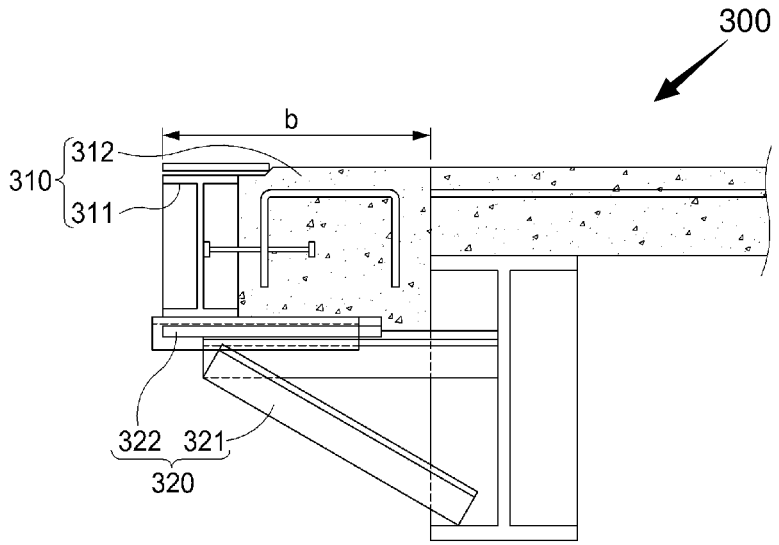
FIG. 10 is a view illustrating a structure of a sill bracket in accordance with an embodiment of the present invention.
Figure 11:
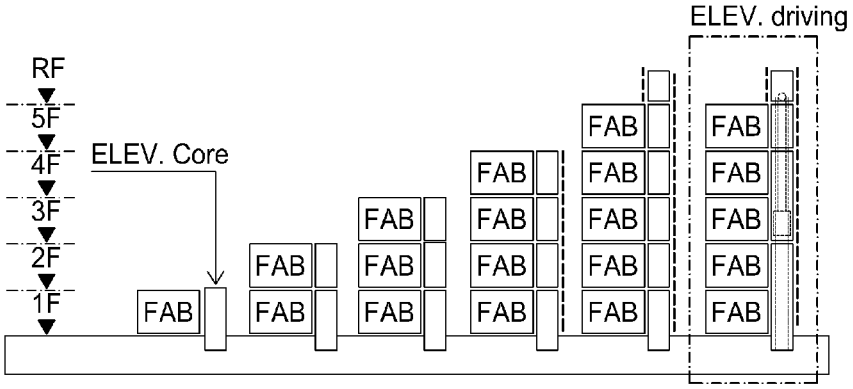
FIG. 11 is a view illustrating a construction schedule of a building in accordance with a typical construction method.
Figure 12:
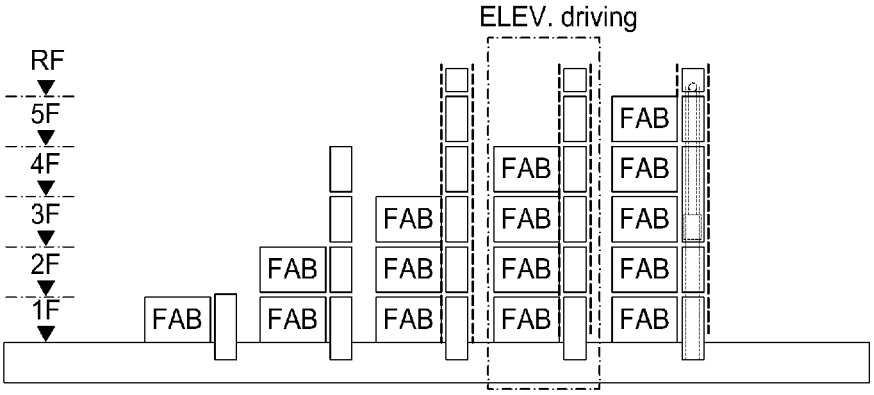
FIG. 12 is a view illustrating a construction schedule of a building constructed by an elevator core early construction method in accordance with an embodiment of the present invention.
Figure 13:
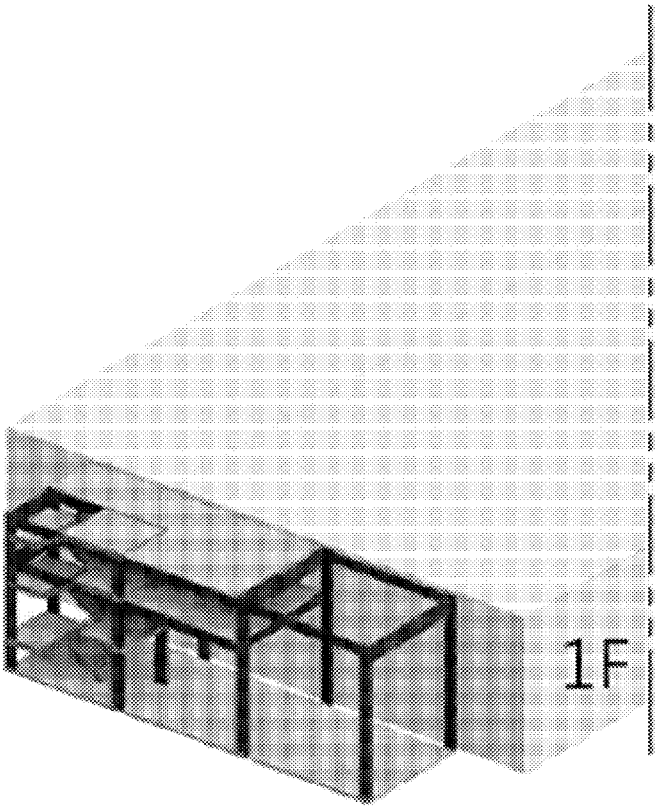
FIGS. 13 to 18 are three-dimensional views illustrating a construction schedule of a building in accordance with a typical construction method.
Figure 14:
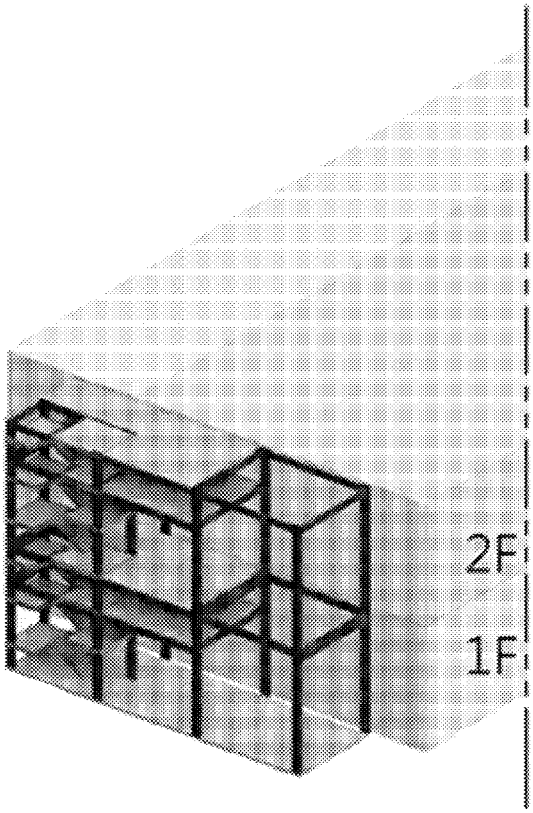
Figure 15:
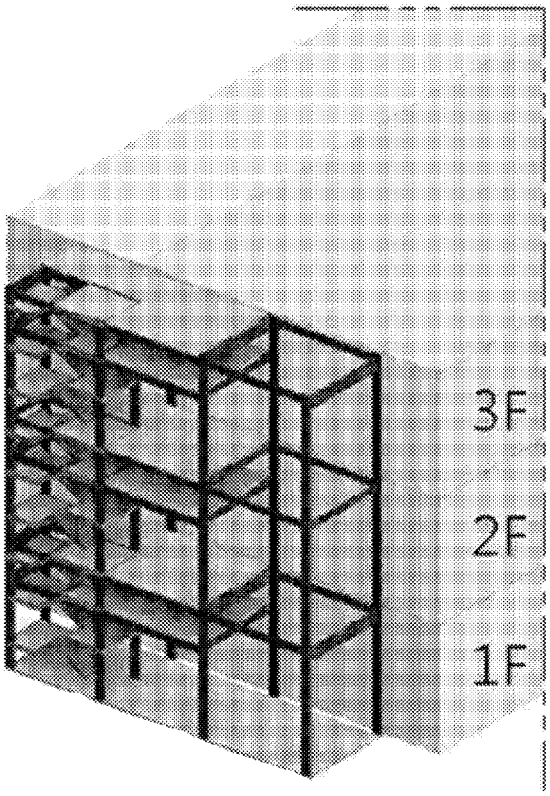
Figure 16:
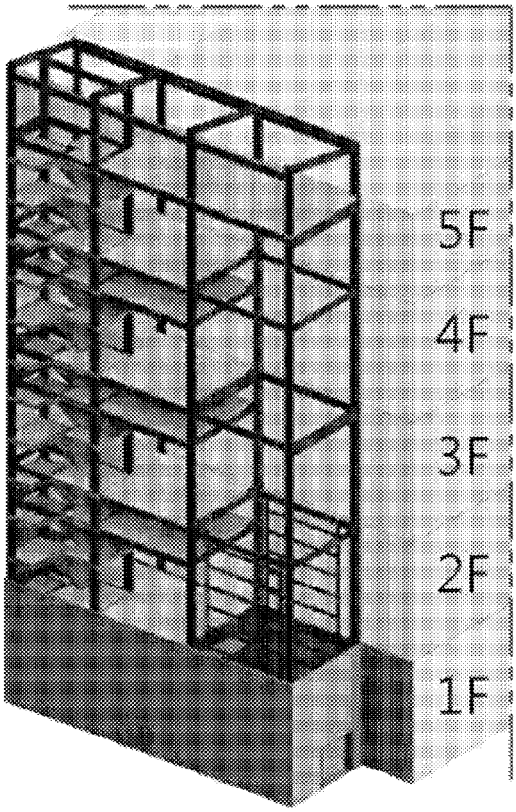
Figure 17:
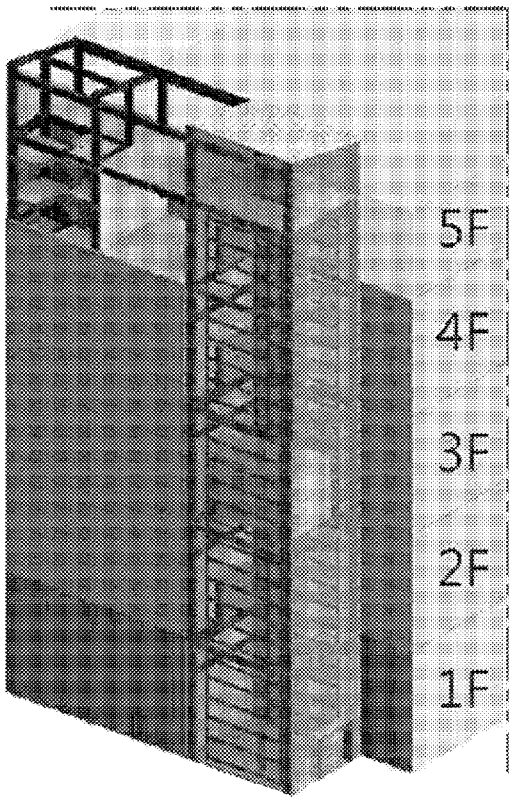
Figure 18:
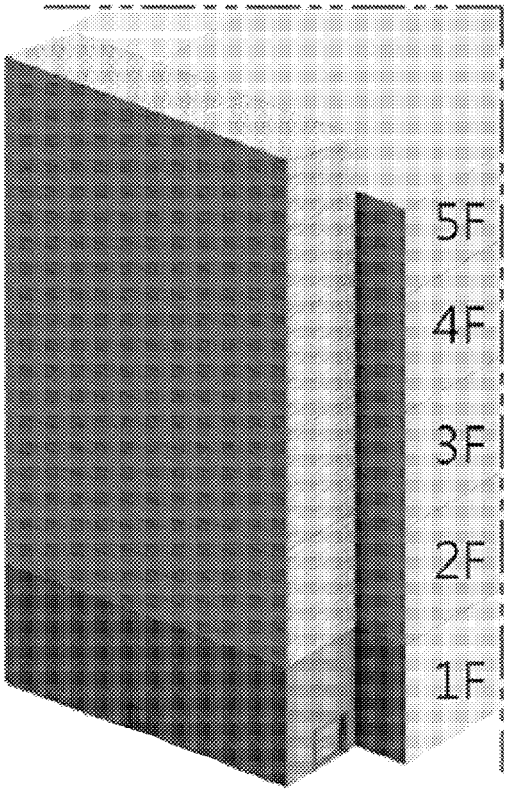
Figure 19:
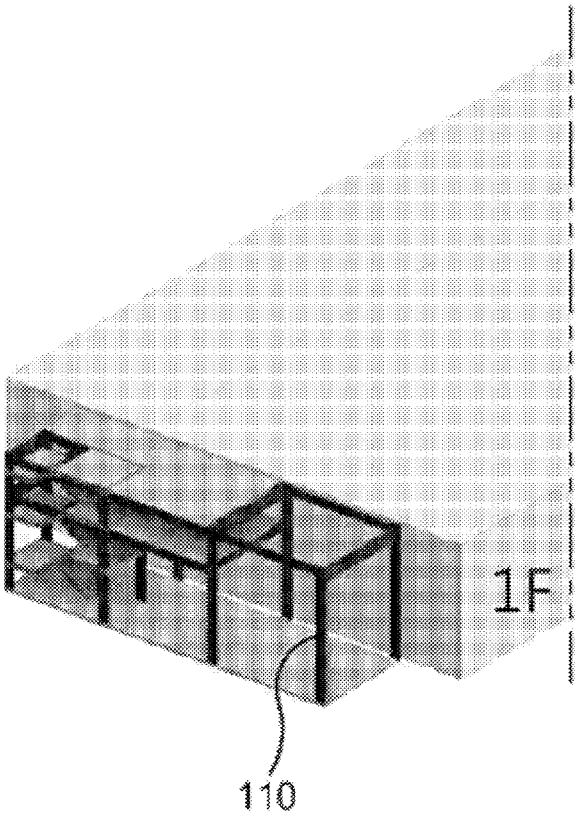
FIGS. 19 to 22 are three-dimensional views illustrating a construction schedule of a building constructed by an elevator core early construction method in accordance with an embodiment of the present invention.
Figure 20:
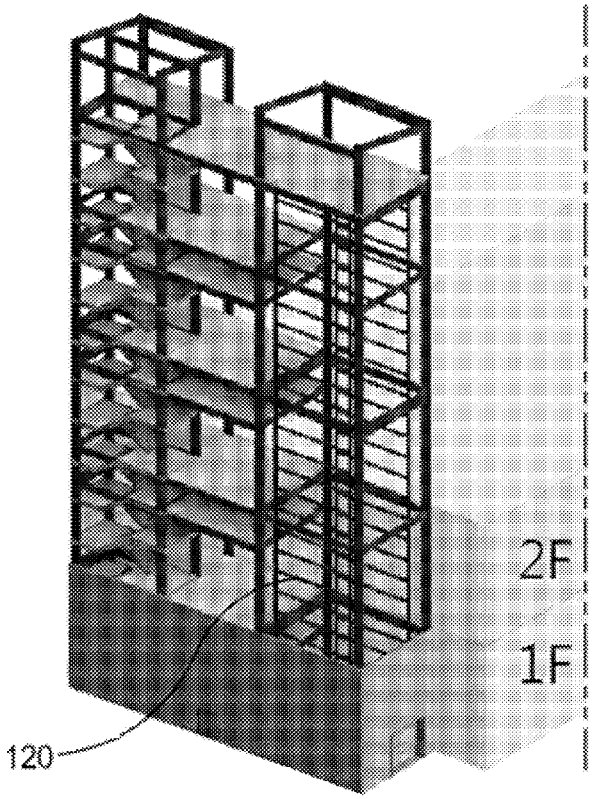
Figure 21:
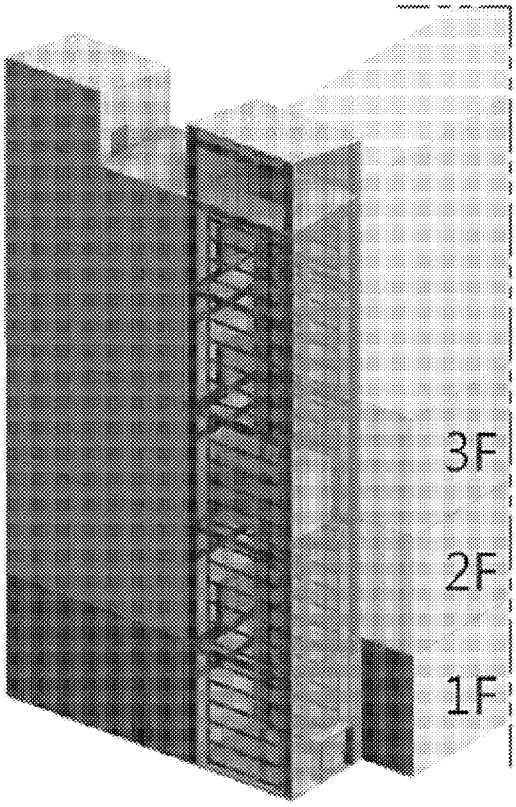
Figure 22:
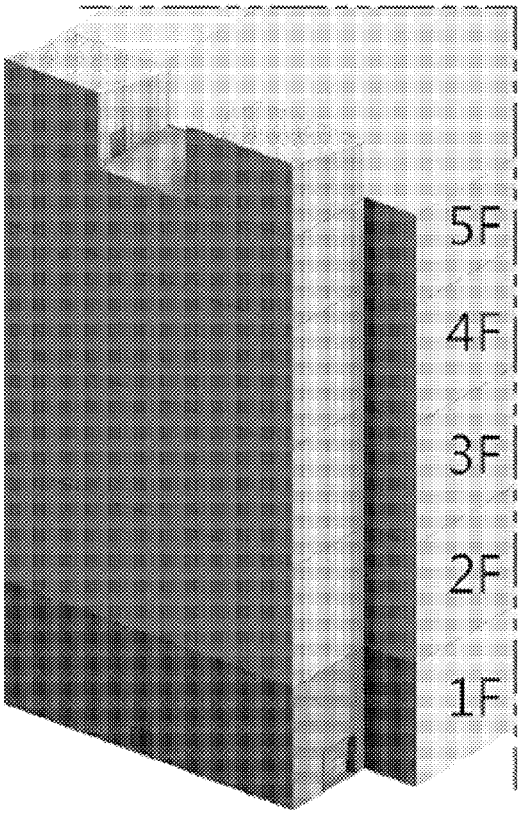
Figure 23:
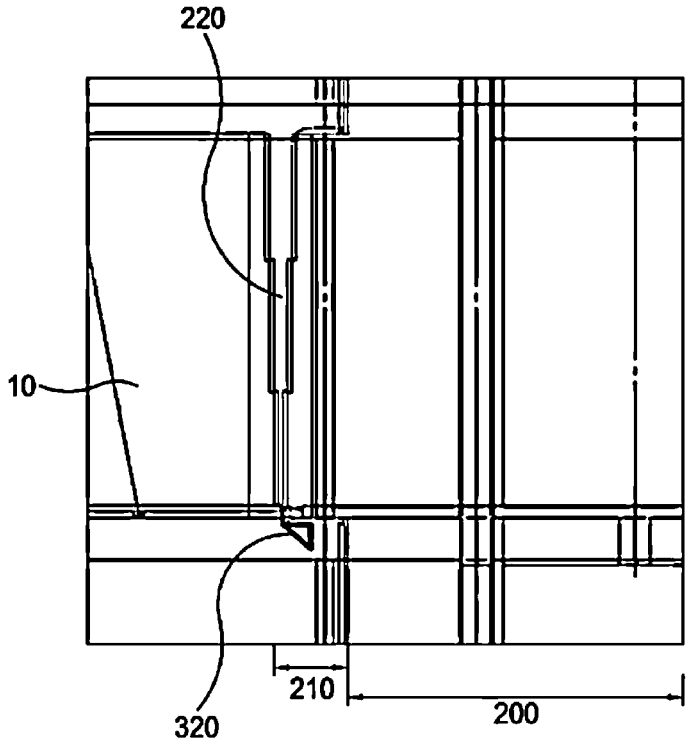
FIG. 23 is a view illustrating formation positions of a jamb and a sill in accordance with an embodiment of the present invention.

The early construction elevator core structure in accordance with an embodiment of the present invention may further include a sealing part 300 (corresponding to a sill installation part) disposed between the elevator hoistway 210 and the elevator unit 10 (refer to FIG. 10).

The sealing part 300 is defined by a concept including sill concrete that is poured by an in-site pouring method between an H-beam, which is generally referred to as a sill, and an H-beam elevator hoistway.

In this case, the sealing part 300 may include a horizontal beam 310 extending in a width direction a of the elevator unit 10 and a bracket 320 installed below the horizontal beam 310 and coupled to the main frame 110 to support the horizontal beam 310.

The horizontal beam 310 may include an H-beam 311 disposed on a movable plate 322 and a concrete member 312 formed by in-site pouring in a space between the H-beam 311 and the main frame 110.

While a typical bracket 320 directly supports a horizontal beam 310, the bracket 320 in accordance with the present invention has a structure including an angle 321 coupled with the main frame 110 and a movable plate 322 disposed on the angle 321 and moving in a thickness direction b of the horizontal beam 310. Thus, a formation position of the horizontal beam 310 may be flexibly varied by adjusting a position of the movable plate 322.

Accordingly, a limitation of a clearance variation of the main frame 110, which may occur by the early construction of the elevator core, may be overcome through the position adjustment of the movable plate 322.

Hereinafter, an early construction method capable of constructing the elevator core earlier than the main frame by applying the early construction elevator core structure in accordance with an embodiment of the present invention will be described.

The early construction method of the elevator core in accordance with the present invention may include: a first process S100 of simultaneously constructing the main frame 110 and the elevator frame 120; a second process S200 of attaching a cove plate 122 to an outer surface of the elevator frame 120; and a third process S300 of inserting the elevator unit 10 to the elevator frame 120.

In this case, a first jamb 221 may be mounted after the first process S100, and a second jamb 221 may be separated and mounted after the third process S300.

That is, the second jamb 221 may be mounted after the main frame 110 is completely constructed.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

INDUSTRIAL APPLICABILITY

The present invention relates to an elevator core structure that is usable in an industrial field.

The invention claimed is:

1. An elevator core structure comprising:

an elevator frame (120) separated from a main frame (110) and extending in a longitudinal direction of the main frame (110);

a guide frame (130) formed on an inner surface of the elevator frame (120);

an elevator unit (10) inserted to the elevator frame 120);

a front room (200) formed in the main frame (110), wherein the front room (200) includes an elevator hoistway (210) configured to connect the elevator unit (10) and the front room (200); and a sealing part (300) disposed between the elevator hoistway (210) and the elevator unit (10), wherein the sealing part (300) includes a horizontal beam (310) extending in a width direction (a) of the elevator unit (10); and a bracket (320) installed below the horizontal beam (310) and coupled to the main frame (110) to support the horizontal beam (310), wherein the bracket (320) includes an angle (321) coupled with the main frame (110); and a movable plate (322) disposed on the angle (321) and moving in a thickness direction (b) of the horizontal beam (310), and wherein the horizontal beam (310) includes a H-beam (311) disposed on the moveable plate (322); and a concrete member (312) formed by on-site pouring into a space between the H-beam (311) and the main frame (110).

2. The elevator core structure of claim 1, wherein the elevator frame (120) is formed by stacking a plurality of frame segments (121), and a guide frame unit (131) forming the guide frame (130) is mounted to one surface of each of the frame segments (121).

3. The elevator core structure of claim 2, wherein the front room (200) further comprises:

a jamb (220) mounted to each of both side surfaces of the elevator hoistway (210).

4. The elevator core structure of claim 3, wherein the jamb (220) comprises:

a first jamb (221) mounted to the elevator frame (120); and a second jamb (222) mounted to the main frame (110).

5. The elevator core structure of claim 4, wherein the first jamb (221) and the second jamb (222) closely contact each other.

6. An early construction method of an elevator core by using the early construction elevator core structure of claim 1, comprising:

a first process (S100) of simultaneously constructing the main frame (110) and the elevator frame (120);

a second process (S200) of attaching a cove plate (122) to an outer surface of the elevator frame (120); and a third process (S300) of inserting the elevator unit (10) to the elevator frame (120).

7. The early construction method of claim 6, further comprising:

an early mounting process (S110) of mounting the first jamb (221) after the first process (S100); and an early mounting process (S310) of mounting the second jamb (222) after the third process (S300).

8. The early construction method of claim 7, wherein the second jamb (221) is mounted after the main frame (110) is completely constructed.

* * * * *